US007708348B2

(12) United States Patent
Barr

(10) Patent No.: US 7,708,348 B2
(45) Date of Patent: May 4, 2010

(54) FOOTSTOOL WITH FOOTREST PLATFORM ADJUSTABLE TO DIFFERENT ANGLES

(75) Inventor: David Alan Barr, Arlington, TX (US)

(73) Assignee: KidKraft LP, Dallas, TX (US)

( * ) Notice: Subject to any disclaimer, the term of this patent is extended or adjusted under 35 U.S.C. 154(b) by 801 days.

(21) Appl. No.: 11/031,674

(22) Filed: Jan. 7, 2005

(65) Prior Publication Data

US 2005/0187074 A1 Aug. 25, 2005

Related U.S. Application Data

(60) Provisional application No. 60/534,908, filed on Jan. 8, 2004.

(51) Int. Cl.
*A47C 16/00* (2006.01)

(52) U.S. Cl. ..... 297/423.46; 297/423.44; 108/8

(58) Field of Classification Search ..... 297/423.41, 297/423.44, 423.46; 482/79, 80; 108/5, 108/8

See application file for complete search history.

(56) References Cited

U.S. PATENT DOCUMENTS 5,577,806 A * 11/1996 Ugalde ..... 297/423.46
5,584,535 A * 12/1996 Jacobson et al. .... 297/423.46 X

FOREIGN PATENT DOCUMENTS

DE 3728717 A * 3/1989

* cited by examiner

*Primary Examiner*—Anthony D Barfield
(74) *Attorney, Agent, or Firm*—Robert D. McCutcheon

(57) ABSTRACT

A footstool with a footrest platform that is adjustable to different positions/angles. The footstool includes a first sidepiece and a second sidepiece engaged by a platform, which is adjustable to one of a plurality of possible positions corresponding to one of a plurality of possible angles. In one embodiment, the sidepieces each have two notches and the platform has protrusions or extensions that engage the notches in the respective position(s). In one position, the protrusions on the platform engage one notch on each sidepiece; in the other position, the protrusions engage the other notch on each sidepiece.

19 Claims, 4 Drawing Sheets

FOOTSTOOL WITH FOOTREST PLATFORM ADJUSTABLE TO DIFFERENT ANGLES

CROSS-REFERENCE TO RELATED APPLICATIONS

This application claims benefit and priority (under 35 U.S.C. §119(e)) to prior U.S. provisional application Ser. No. 60/534,908 filed on Jan. 8, 2004, and which is incorporated herein by reference.

TECHNICAL FIELD OF THE INVENTION

The present invention relates to footstools and, in particular, to a footstool with a footrest platform adjustable to different angles.

BACKGROUND

A person feeding a baby will raise the baby's head during feeding—a mother, to hold the child to her breast; or any caregiver, to hold a bottle to the child's mouth. If seated with her feet on the floor, the person may use her arm to raise the baby's head, however, over prolonged periods of feeding, this is likely to result in fatigue of the arm, shoulder and back. Prolonged periods of sitting, too, can lead to discomfort in the person's legs and lower back.

A solution to both problems is for the person to elevate one or both feet on a footstool. This change in posture reduces the strain on her legs and lower back from sitting for long periods. Elevating one or both legs also allows her to rest her elbow or forearm on her raised thigh, thereby relieving the muscular strain of holding up the baby's head.

A footstool with a horizontal footrest platform may elevate the person's leg, but the force applied by her foot to the platform may be largely parallel to the surface of the footstool, depending upon the height of the platform relative to the height of her seat. The friction between her foot and the platform, which keeps her foot on the platform, is proportional to the force her foot exerts normal to the surface of the platform, rather than the force along the surface. Therefore, if the force applied by her foot to the platform is largely parallel to the surface of the footstool, her foot is more likely to slip and she will be required to exert more effort to keep her foot in position. A platform surface with a high coefficient of friction can reduce this slippage, but may be uncomfortable to a bare foot. A lower footstool may minimize the effort required, but may also not provide adequate elevation to ease the fatigue of raising the baby's head.

A footstool with a footrest platform angled toward the person can increase the normal force applied by the foot in relation to the force applied across the surface of the platform. If such a footstool has a platform at a fixed angle, however, it may still not be comfortable, depending upon the height of the person, the height of her seat, the distance of the footstool from the person, and other factors.

Many other problems and disadvantages of the prior art will become apparent to one skilled in the art after comparing such prior art with the present invention as described herein.

SUMMARY

In view of the foregoing disadvantages inherent in the known types of footstools now present in the prior art, the present invention provides a footstool with a footrest platform whose position can be adjusted to different angles.

In one embodiment of the present invention, there is provided a footstool having a first sidepiece and a second sidepiece. A platform is provided that is operable for engaging the first sidepiece and the second sidepiece, wherein the platform is adjustable from a first position to a second position, the first position defining the platform at a first angle and the second position defining the platform at a second angle.

In another embodiment of the present invention, there is provided a footstool including a platform having a first extension member and a second extension member. A first leg member having a first notch and a second notch is operable for supporting the platform while a second leg member having a third notch and a fourth notch is also operable for supporting the platform. A structural member extends between and rigidly connects the first leg member and the second leg member. The platform is oriented at a first angle when the platform is in a first position and oriented at a second angle when the platform is in a second position.

In yet another embodiment, there is provided a footstool having a platform and a first leg member and a second leg member rigidly connected to a structural member extending between the first leg member and the second leg member. The first and second leg members are operable for supporting the platform. The footstool further includes means for positioning the platform at one of a plurality of angled positions.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art should appreciate that they may readily use the conception and the specific embodiment disclosed as a basis for modifying or designing other structures for carrying out the same purposes of the present invention. Those skilled in the art should also realize that such equivalent constructions do not depart from the spirit and scope of the invention in its broadest form.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION OF THE INVENTION

Figure 1:
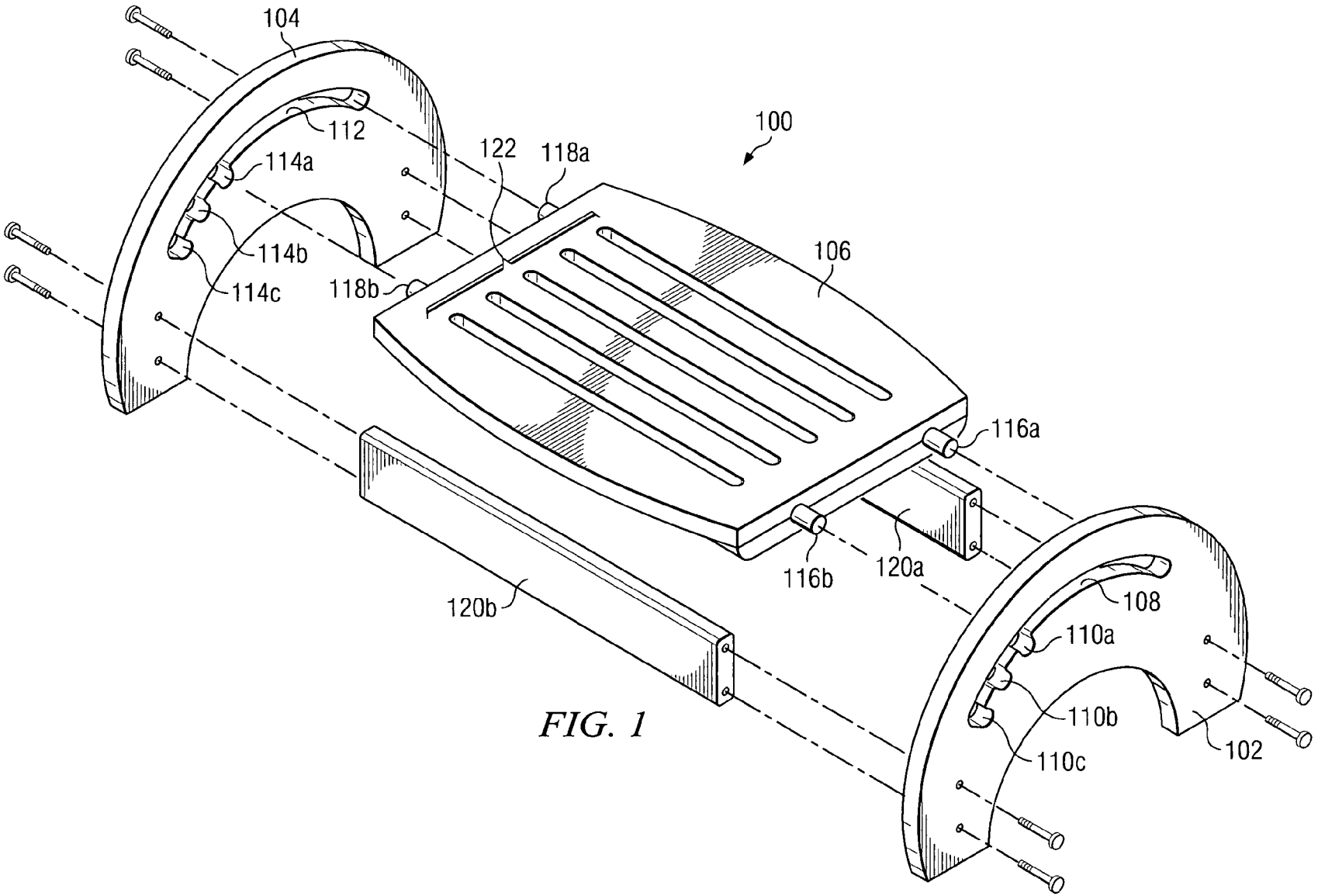
FIG. 1 is an orthogonal view of one embodiment of a footstool in accordance with the present invention.

With reference to FIG. 1, there is shown one embodiment of a footstool 100 in accordance with the present invention. The footstool includes sidepieces (or leg members) 102, 104 and a platform 106. The sidepieces 102, 104 include one or more legs (or leg members) for the stool 100 to support the platform 106, and each is constructed as a single unitary member, but could also be constructed of multiple members. The sidepieces may also be referred herein as legs or leg members.

In the embodiment shown, each sidepiece includes two extensions that function as legs. The sidepieces 102 and 104 are connected by structural members 120*a* and 120*b* which function to hold the sidepieces 102 and 104 at respective positions from each other, and in one embodiment, position the sidepieces parallel to, and at a fixed distance from, each other. The structural member rigidly connects the sidepieces. As will be appreciated, the selection and use of different materials of construction for the stool 100 and the specific assembly connections utilized for structural members may vary and are generally known to those skilled in the art.

The sidepieces 102 and 104 are shown with arcuate grooves 108 and 112, respectively. The groove 108 has notches 110*a*, 110*b* and 110*c* at the front end of the groove, located in its lower edge. The groove 112 has corresponding notches 114*a*, 114*b* and 114*c* in its lower edge at the front end of the groove. The platform 106 has protrusions or extensions 116*a* and 116*b* on one side, which engage the groove 108, and protrusions or extensions 118*a* and 118*b* on the opposite side, which engage the groove 112. The top surface of the platform 106 has grooves 122 to help resist slipping of a foot resting on the platform 106. The protrusions or extensions 116*b*, 118*b* are formed or designed to fit or seat within the respective notches 110*a*-110*c*, 114*a*-114*c* when the platform 106 is in a predetermined position, as described below. It will be understood that other shapes for the grooves and the notches may used, as well as orientations for the grooves 108, 112. In another embodiment, each sidepiece 102, 104 may have two separate grooves for the rear and from protrusions or extensions 116 and 118, respectively. Other embodiments may include different shaped grooves (i.e, different radius of curvature or straight grooves at an angle, etc.).

The platform 106 may be positioned so that the protrusions 116*b* and 118*b* engage the notches 110*a* and 114*a*, respectively. When so positioned (first angled position), the platform 106 would be held in a first position, with its front lowered slightly relative to its back, thereby forming a slight angle to the horizontal. The platform 106 also may be positioned so that the protrusions 116*b* and 118*b* engage the notches 110*b* and 114*b*, respectively. In this second position (second angled position), the front of the platform 106 is further lowered and the platform 106 is at a greater angle to the horizontal. The platform 106 also may be positioned so that the protrusions 116*b* and 118*b* engage the notches 110*c* and 114*c*, respectively. In this third position (third angled position), the front of the platform 106 is even lower and the platform 106 is at an even greater angle to the horizontal. As will be appreciated, the end of the grooves 108, 112 may also be considered to be notches. Thus, the angle of the platform 106 (i.e., the platform or its upper surface) may be adjusted to one of a plurality of angled positions by selectively engaging the protrusions 116*b* and 118*b* with the notches 110*a* and 114*a*, 110*b* and 114*b*, or 110*c* and 114*c*, respectively.

As will be appreciated, the angle of the platform in any of the positions may be any number of degrees (i.e., −90 degrees to +90 degrees) from the horizontal, as desired. Further, one of the positions may result in the platform being horizontal (e.g., zero degrees from the horizontal). Thus, the grooves, protrusions and notches (and their positioning) provide a mechanism to adjust the angle of the platform to different angles (from a predetermined reference point or horizontal, such as the floor).

As the platform 106 is repositioned to engage a selected pair of notches, the protrusions 116*a* and 118*a* slide to a corresponding position at the other end of the grooves 108 and 112, respectively. While only one end portion of the grooves 108 and 112 have notches in the footstool 100, it will be understood by one skilled in the art that, in another embodiment of the invention, corresponding notches could be placed in the back ends of grooves 108 and 112 for the protrusions 116*a* and 118*a* to engage in each of the three positions described above. A person skilled in the art will also understand that, while the grooves 108 and 112 and the protrusions 116*a*, 116*b*, 118*a* and 118*b* extend all the way through the sidepieces 102 and 104 in the footstool 100, the grooves 108 and 112 could be constructed so as not to extend all the way through the sidepieces 102 and 104 and leaving their outer sides smooth and solid. The protrusions 116*a*-*b* and 118*a*-*b* would be made correspondingly shorter in such an embodiment of the invention.

In an alternative embodiment (not shown), the back portion (or front portion) of the platform 106 may be configured to pivot about a fixed axis pivot point (likely positioned at the junction of the platform and the sidepieces and using a pivot mechanism). With such configuration, an arcuate-shaped groove may be constructed within the front portion (or back portion) of the sidepieces to receive the extensions or rods 116*b*, 118*b*. In this embodiment, no notches are necessary as a tightening mechanism (e.g., bolt, handle and screw, etc.) may be utilized to rigidly affix the platform at the desired location (e.g., the extensions may comprise threads extending through the groove and a threaded bolt with a body portion may be turned to tighten/loosen the mechanism allowing the extensions to slide within the groove).

Figure 2A:
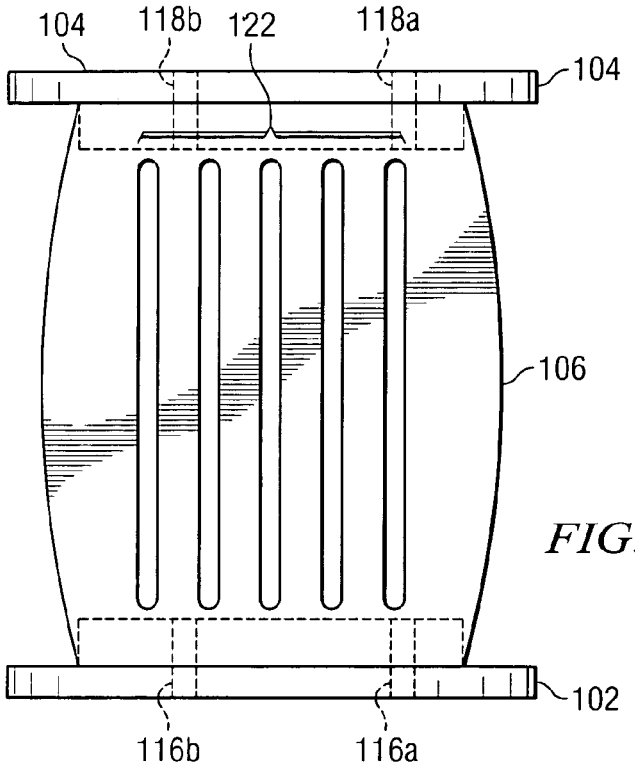
FIGS. 2*a*, 2*b* and 2*c* are top, side and front views, respectively, of the footstool shown in FIG. 1.
Figure 2B:
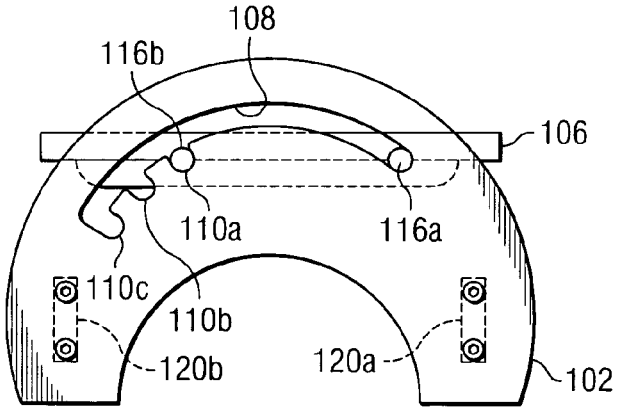
Figure 2C:
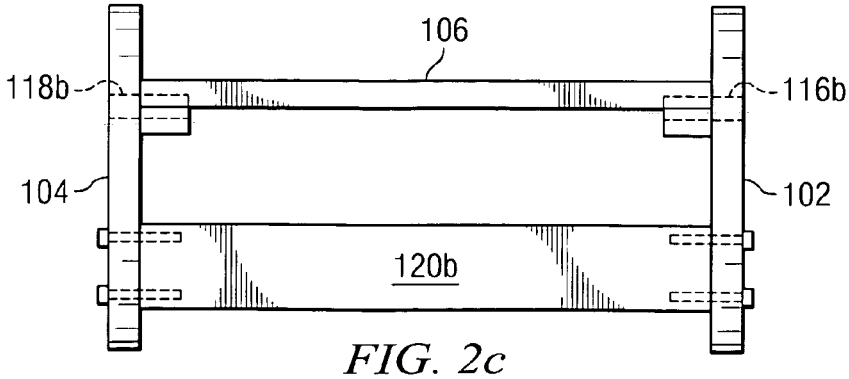

FIGS. 2*a*, 2*b* and 2*c* show views from the top, right side and front, respectively, of the footstool 100, to more clearly illustrate the relationships of the various elements of this embodiment of the present invention.

In another embodiment of the present invention (not shown), the sidepieces 102 and 104 may be equipped with protrusions located along the same arcuate paths followed by the grooves 108 and 112 and located in positions corresponding to the notches 110*a*-*c* and 114*a*-*c* and to the corresponding positions in the grooves obtained by the protrusions 116*a* and 118*a*. The platform 106 may be equipped with four notches on its bottom side in positions corresponding to the protrusions 116*a*-*b* and 118*a*-*b*. In such an embodiment, the platform 106 might be positioned so that its notches engage various ones of the protrusions on sidepieces 102 and 104, thereby being held in each of plurality of positions described above for platform 106 of footstool 100.

Figure 3A:
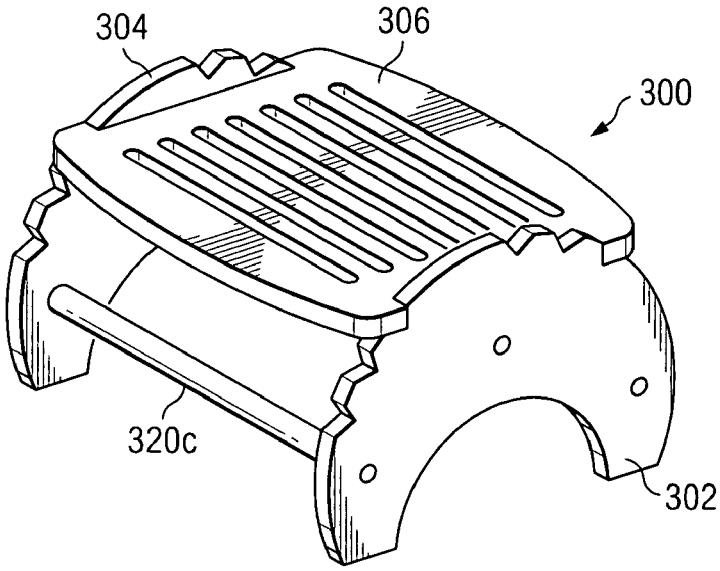
FIG. 3*a* is an orthogonal view of a footstool in accordance with the present invention.
Figure 3B:
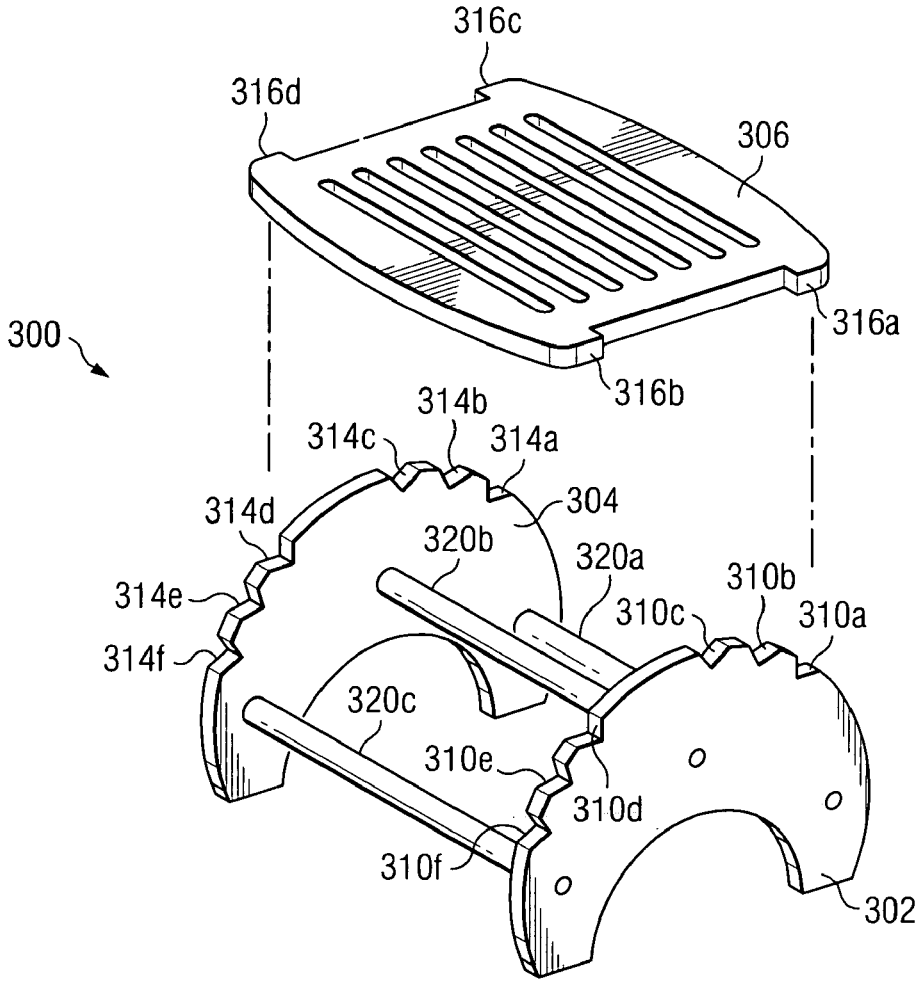
FIG. 3*b* is an exploded orthogonal view of the footstool shown in FIG. 3*a;*

With reference to FIGS. 3*a* and 3*b*, there is shown another embodiment of a footstool 300 in accordance with the present invention. The footstool 300 includes sidepieces 302 and 304, which are connected by structural members 320*a-c* (only structural member 320*c* is visible in FIG. 3*a*). The sidepieces 302 and 304 may be similar in nature to those as described above (e.g., the sidepieces 102 and 104). The structural members 320*a-c* function to hold the sidepieces 302 and 304 at respective positions from each other, and in one embodiment, position the sidepieces parallel to, and at a fixed distance from, each other. A platform 306 engages and rests on top of the sidepieces 302 and 304, with protrusions or extensions 316*a-d* engaging various ones of notches 310*a-f* in sidepiece 302 and notches 314*a-f* in sidepiece 304, respectively.

In FIG. 3*a*, the protrusions or extensions 316*a-d* are shown engaging notches 310*a*, 310*d*, 314*a* and 314*d*, respectively. As a result, the platform 306 is held in a first position at a slight angle to the horizontal (first angled position). The protrusions 316*a-d* may alternatively engage the notches 310*b*, 310*e*, 314*b* and 314*e*, respectively, thereby holding the platform 306 is a second position. In the second position (second angled position), the front edge of the platform 306 is further lowered relative to its back edge and the platform is at a greater angle to the horizontal. The platform 306 may be held in yet a third position by engaging the protrusions 316*a-d* with the notches 310*c*, 310*f*, 314*c* and 314*f*, respectively. In the third position (third angled position), the front edge of the platform 106 is even lower still and the platform is at an even greater angle to the horizontal. Additional positions may be used. Thus, the angle of the platform 306 may be adjusted to one of a plurality of angled positions by selectively engaging the protrusions 316 with the various notches 310 and 314, respectively.

As will be appreciated, the angle of the platform 306 in any of the positions may be any number of degrees (i.e., −90 degrees to +90 degrees) from the horizontal, as desired. Further, one of the positions may result in the platform being horizontal (e.g., zero degrees from the horizontal). Thus, the protrusions and notches (and their positioning) provide a mechanism to adjust the angle of the platform to different angles (from a predetermined reference point or horizontal, such as the floor).

Figure 4:
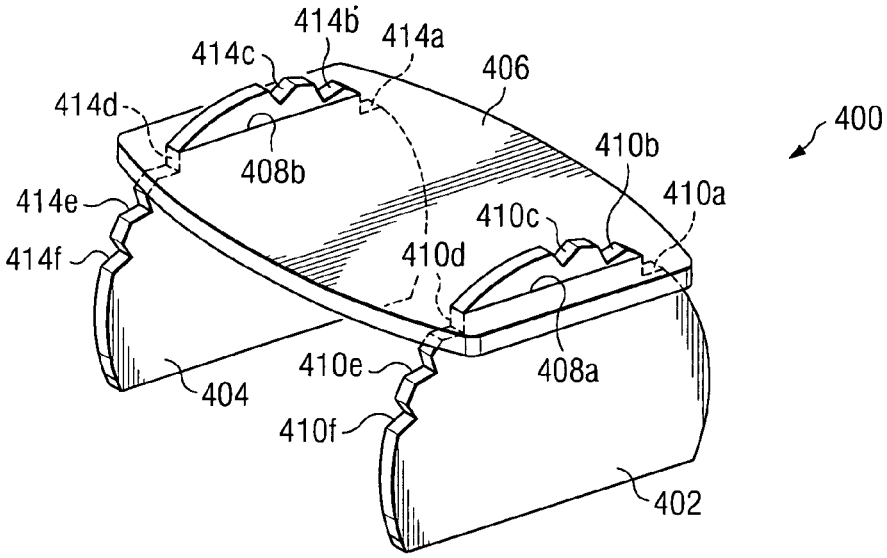
FIG. 4 is an orthogonal view of another embodiment of a footstool in accordance with the present invention.
Figure 5:
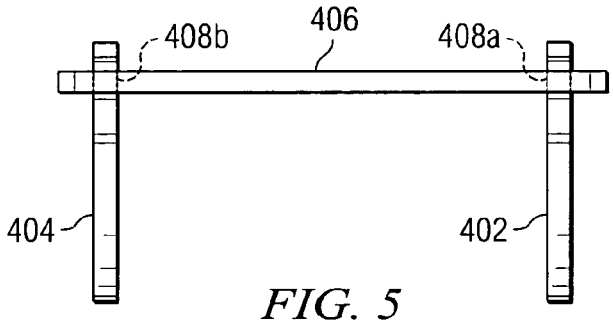
FIG. 5 is a front view of the footstool shown in FIG. 4.
Figure 6A:
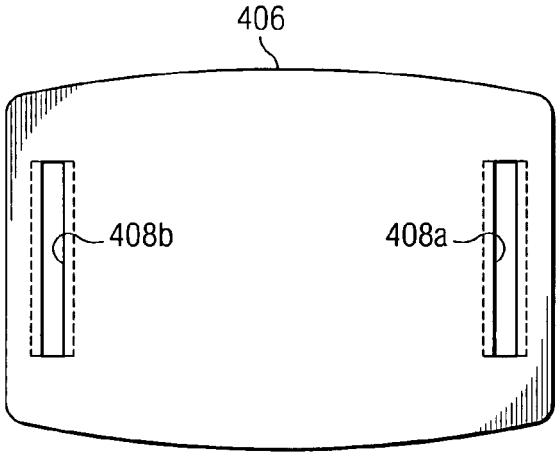
FIG. 6*a* is a top view of the platform of the footstool shown in FIG. 4.
Figure 6B:
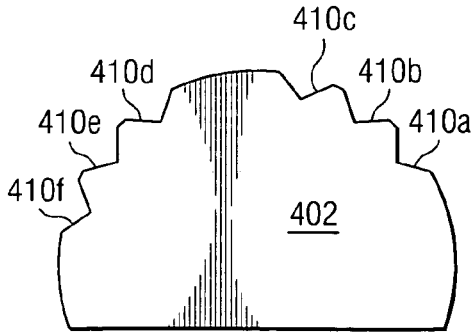
FIG. 6*b* is a side view of a sidepiece of the footstool shown in FIG. 4.

Now referring to FIG. 4, there is shown a footstool 400 in accordance with yet another embodiment of the present invention. The footstool 400 includes the sidepieces 402 and 404 and the platform 406 (additional structural members similar to members 120 and 320 may be used). As shown in FIG. 5, the sidepieces 402 and 404 extend through openings or grooves 408*a* and 408*b*, respectively, in the platform 406. The inner walls of the openings 408*a* and 408*b* engage the sides of the sidepieces 402 and 404, thereby holding and positioning the sidepieces substantially parallel and vertical. A top view of the platform 406 and a side view of the sidepiece 402 are shown in FIGS. 6*a* and 6*b*, respectively, to more clearly illustrate the features of these two elements.

With reference again to FIG. 4, the platform 406 may be positioned so that the ends of the opening 408*a* engage the notches 410*a* and 410*d* and the ends of the opening 408*b* engage the notches 414*a* and 414*d*. So positioned, the platform is at a slight angle to the horizontal (first angled position). Alternatively, the platform 406 may be positioned so that the ends of the opening 408*a* engage the notches 410*b* and 410*e* and the ends of the opening 408*b* engage the notches 414*b* and 414*e*. In this second position (second angled position), the front edge of the platform 406 is further lowered and the platform is at a greater angle to the horizontal. The platform 406 may also be positioned so that the ends of the opening 408*a* engage the notches 410*c* and 410*f* and the ends of the opening 408*b* engage the notches 414*c* and 414*f*. The platform 406 is at an even greater angle to the horizontal in this third position (third angled position). Thus, the angle of the platform 406 may be adjusted to one of a plurality of angled positions by selectively engaging the openings 408 with the various notches 410 and 414, respectively, and the configuration and mechanism of the stool 400 is similarly operable as described above with respect to the stools 100, 300.

Although the present invention and its advantages have been described in the foregoing detailed description and illustrated in the accompanying drawings, it will be understood by those skilled in the art that the invention is not limited to the embodiment(s) disclosed but is capable of numerous rearrangements, substitutions and modifications without departing from the spirit and scope of the invention as defined by the appended claims.

What is claimed is:

1. A footstool, comprising:

a first sidepiece having a groove having a first surface, the first surface having a first notch and a second notch;

a second sidepiece having a groove having a second surface, the second surface having a third notch and a fourth notch;

a platform operable for engaging the first sidepiece and the second sidepiece, and wherein the platform is adjustable from a first position to a second position, the first position defining the platform at a first angle and the second position defining the platform at a second angle; and wherein the platform comprises a first extension, a second extension, a third extension, and a fourth extension, the groove of the first sidepiece operable for receiving the first extension and the third extension simultaneously on the first surface, and the groove of the second sidepiece operable for receiving the second extension and the fourth extension simultaneously on the second surface and wherein the platform is at the first angle when the first and second extensions engage the first and third notches, respectively, and at the second angle when the first and second extensions engage the second and fourth notches, respectively.

2. The footstool in accordance with claim 1 wherein the grooves within the first sidepiece and the second sidepiece are arcuate-shaped.

3. The footstool in accordance with claim 1 wherein the first notch and the second notch of the first sidepiece are positioned proximate an edge of the first sidepiece, and the first notch and the second notch of the second sidepiece are positioned proximate an edge of the second sidepiece.

4. The footstool in accordance with claim 1 wherein the first sidepiece further comprises a fifth notch operable for receiving the first extension when the platform is in a third position, and the second sidepiece comprises a sixth notch operable for receiving the second extension when the platform is in the third position.

5. A footstool, comprising:

a platform having a first extension member, a second extension member, a third extension member, and a fourth extension member;

a first leg member having a groove having a first surface, the first surface having a first notch and a second notch, the first leg member operable for supporting the platform;

a second leg member having a groove having a second surface, the second surface having a third notch and a fourth notch, the second leg member operable for supporting the platform;

a structural member extending between and rigidly connecting the first leg member and the second leg member;

wherein the platform is oriented at a first angle when the platform is in a first position and oriented at a second angle when the platform is in a second position; and wherein the groove of the first leg member is operable to receive the first and third extension members and the groove of the second leg member is operable to receive the second and fourth extension members, and wherein the first and third notches are operable to receive the first and second extension members when the platform in is the first position and the second and fourth notches are operable to receive the first and second extension members when the platform is in the second position such that the platform is at the first angle when the extension members engage the first and third notches and at the second angle when the extension members engage the second and fourth notches.

6. The footstool in accordance with claim 5 wherein the notches and the extension members are operable for supporting the platform in the respective positions.

7. The footstool in accordance with claim 5 wherein the first leg member further comprises a fifth notch and the second leg member further comprises a sixth notch, and wherein fifth and sixth notches are operable to receive the first and second extension members, respectively when the platform is in a third position.

8. The footstool in accordance with claim 5 wherein the first leg member comprises a first groove for receiving the first and third extension members and the second leg member comprises a second groove for receiving the second and fourth extension members.

9. The footstool in accordance with claim 8 wherein the first groove and the second groove are arcuate-shaped.

10. The footstool in accordance with claim 5 wherein the first and second notches are positioned proximate an edge of the first leg member, and the third and fourth notches are positioned proximate an edge of the second leg member.

11. A footstool, comprising:

a platform;

a first leg member and a second leg member rigidly connected to a structural member extending between the first leg member and the second leg member, the first and second leg members operable for supporting the platform; and means for adjusting the platform to one of a plurality of angled positions by selectively engaging a first platform extension with a one of a first plurality of notches in a first surface of a groove of the first leg member while simultaneously engaging a third platform extension with the first surface of the first leg member, selectively engaging a second platform extension with a one of a second plurality of notches in a second surface of a groove of the second leg member while simultaneously engaging a fourth platform extension with the second surface of the second leg member.

12. The footstool in accordance with claim 11 wherein the platform is adjustable to a first position and a second position, whereby the platform in the first position engages the first extension within a first notch of the first leg member and engages the second extension within a second notch of the second leg member, and whereby the platform in the second position engages the first extension within a third notch of the first leg member and engages the second extension within a fourth notch of the second leg member, a surface of the platform oriented at a first angle from a horizontal and oriented at a second angle when in the first position and in the second position, respectively.

13. The footstool in accordance with claim 12, wherein the platform is adjustable to a third position, whereby the platform in the third position engages the first extension within a fifth notch of the first leg member and engages the second extension within a sixth notch of the second leg member, the surface of the platform oriented at a third angle from the horizontal when in the third position.

14. The footstool in accordance with claim 11, wherein the first surface is a surface of a first groove in the first leg member and the second surface is a surface of a second groove in the second leg member.

15. The footstool in accordance with claim 14, wherein the first groove and the second groove are arcuate-shaped.

16. The footstool in accordance with claim 11, wherein the first surface is an outer edge of the first leg member and the second surface is an outer edge of the second leg member.

17. A footstool, comprising:

a platform having a first extension member, a second extension member, a third extension member and a fourth extension member;

a first leg member having a first groove for receiving the first extension member and the third extension member and having a first notch and a second notch, the first leg member operable for supporting the platform;

a second leg member having a second groove for receiving the second extension member and the fourth extension member and having a third notch and a fourth notch, the second leg member operable for supporting the platform;

a structural member extending between and rigidly connecting the first leg member and the second leg member; and wherein the platform is oriented at a first angle when the platform is in a first position and oriented at a second angle when the platform is in a second position.

18. The footstool in accordance with claim 17 wherein the first groove and the second groove are arcuate-shaped.

19. The footstool in accordance with claim 17 wherein the first leg member further comprises a fifth notch and the second leg member further comprises a sixth notch, and wherein fifth and sixth notches are operable to receive the first and second extension members, respectively when the platform is in a third position.

* * * * *